US007997213B1

(12) United States Patent
Gauthier et al.

(10) Patent No.: US 7,997,213 B1
(45) Date of Patent: Aug. 16, 2011

(54) CARGO CONTAINER CRADLE

(75) Inventors: Garett P. Gauthier, Lafayette, LA (US); Robert L. Gauthier, Sr., Lafayette, LA (US); Robert J. Roger, Houma, LA (US); Robert L. Gauthier, Jr., Lafayette, LA (US)

(73) Assignee: R3G, LLC, Lafayette, LA (US)

( * ) Notice: Subject to any disclaimer, the term of this patent is extended or adjusted under 35 U.S.C. 154(b) by 982 days.

(21) Appl. No.: 11/895,678

(22) Filed: Aug. 27, 2007

(51) Int. Cl.
*B65D 19/38* (2006.01)

(52) U.S. Cl. ..... 108/55.1; 108/53.1; 294/67.1; 211/194; 206/386

(58) Field of Classification Search ..... 294/67.1, 294/67.3, 67.4, 68.1, 68.3; 108/53.1, 53.5, 108/55.1, 56.1, 51.11; 206/386, 509, 511, 206/512; 211/27, 85.8, 189, 194
See application file for complete search history.

(56) References Cited

U.S. PATENT DOCUMENTS 1,522,707 A 1/1925 Andrew et al.
4,266,678 A * 5/1981 Daly ..... 211/194
4,295,431 A * 10/1981 Stavlo ..... 108/55.1
4,452,555 A 6/1984 Calabro
4,626,155 A * 12/1986 Hlinsky et al. ..... 410/82
4,850,786 A 7/1989 Oswald
4,946,036 A 8/1990 Kupersmit
5,507,237 A 4/1996 Barrow et al.
6,286,792 B1 * 9/2001 Best ..... 248/97
6,357,365 B1 3/2002 Higgins et al.
6,726,041 B2 * 4/2004 Dunn ..... 211/194
6,749,388 B1 6/2004 Schmidt
7,097,054 B2 * 8/2006 Beck ..... 206/335
7,152,749 B2 * 12/2006 Beck ..... 211/194
2004/0188433 A1 9/2004 Morales et al.
2006/0118504 A1 6/2006 Willemsen

* cited by examiner

*Primary Examiner* — Saúl J Rodríguez
*Assistant Examiner* — Stephen Vu

(57) ABSTRACT

A modular cradle for reinforcing, transporting, and stacking cargo containers used in the transportation and storage of bulk cargo in the oil and gas industry so as to allow compliance with construction and shipping standards adopted by the oil and gas industry is disclosed. The cargo cradle is comprised of a rectangular frame for holding and supporting a cargo container. The cradle has attached lifting lugs positioned within the interior of the cargo cradle for attachment of lifting cables. The lifting lugs are positioned so as to allow cradles to be stacked one upon the other. The container cradles interlock when stacked.

4 Claims, 9 Drawing Sheets

CARGO CONTAINER CRADLE

FIELD OF INVENTION

This invention relates to the transportation and storage of bulk goods and, more particularly, relates to a support frame for support and storing bulk cargo containers and baskets that will comply with standards for strength and structural integrity adopted by the oil and gas industries.

BACKGROUND OF INVENTION

Bulk packaging containers are used for storage and shipment of bulk goods and equipment and such containers are particularly practical for use in the offshore oil and gas industry. Equipment has typically been moved to and from offshore oil and gas installations and drilling sites in baskets and containers of many different sizes and shapes.

The baskets typically utilized are normally fabricated with an open top and, more often than not, are randomly sized depending upon the designs and specifications of the company building and selling the basket. The containers typically utilized are closed in on all sides including the top and usually have a side door. These containers also come in many different shapes and sizes and have also been traditionally built to the specifications of the manufacturer.

In the past, offshore baskets and containers where slapped together with metal plate, expanded metal, tubing, I beam, or any other materials that a fabricator could find. Without thought, the baskets and containers were loaded down with cargo and sent offshore. Today the basket and container industry is a science in itself. The units are highly engineered pieces of equipment that are thoroughly tested for strength deficiencies and other insufficiencies.

For these reasons the containers and equipment utilized to move equipment on and offshore is continually being changed and modified. Further, the incidence of accidents involving lifting units have prompted many of the world's offshore a companies to rethink and retool their equipment. Rules, regulations, and practices for the use of such containers continue to evolve due to safety concerns and considerations.

The ISO shipping container has brought to the offshore industry a means for standardizing containers and shipping techniques throughout the shipping industry. Standardized containers are frequently employed in the shipping of goods and equipment by sea, rail, or trucking. The primary size used by international shippers is a container unit measuring 20 feet in width by 40 feet in length. However, the industry is developing needs for smaller units such as containers of the length of 10 feet, 8 feet, and even 6 feet in length. Such units are particularly useful in the oil and gas industry because they can be mass-produced and provided at a cost significantly less than custom built units. Such units, principally because of their size, may be more conveniently lifted and stored onto and off of service vessels and oil and gas platforms.

These smaller units also present some problems as manufacturers often ignore standardization requirements and safety concerns in the choice of the material and construction methods employed in production of the units. Further, there is a proliferation of equipment previously manufactured and used that does not necessarily comply with the strength and size requires currently being adopted. These problems may result in the inadvertent or unavoidable use of containers of different sizes and strength capabilities and as a result, their use may increase the risk of injury associated with the handling, lifting, loading, unloading, and transportation of these smaller units. There are two basic solutions to these container deficiencies. One is to implement and enforce standardized specifications for such containers that would ultimately result in increased shipping expenses due to the necessity of discarding or abandoning those containers currently being used. The other is to provide a container cradle that will serve to strengthen and support the container units. The major oil companies are adopting regulations and standards being proposed for lifting loads and capabilities of cargo containers employed in the oil and gas industry. These regulations and standards are intended to prevent or minimize accidents caused by failure of cargo container structures such as baskets, boxes, and the like during lifting and transporting the containers to and from offshore locations. One such offshore container lifting regulation is "DNV Offshore Container Regulation 2.7-1" that has been proposed by Det Norske Veritas, DNV, a Norwegian organization and an internationally recognized certification body. The cargo container cradle disclosed herein, when used in conjunction with a typical bulk cargo container, will satisfy such regulations.

SUMMARY OF THE INVENTION

The cargo container cradle described herein is intended to satisfy and comply with "DNV Offshore Container Regulation 2.7-1, a standard which has been adopted or is being proposed for adoption by many companies utilizing cargo containers. The described cargo container cradle will allow companies to make their existing inventories of cargo containers compliant with DNV Offshore Container Regulation 2.7-1.

The described cargo container cradle will allow the use of existing, non-certified containers for the transportation of cargo from truck, to dock, to boat, to platform all the while complying with the engineering, testing, and quality control requirement of the internationally accepted DNV regulations.

It is an object of this invention to provide a cradle that will allow the units to be stacked one upon the other. This will allow more efficient use of boat space when delivering cargo to and from an offshore platform as well as make more efficient use of the platform space which is typically limited. Consequently, the cradle will allow fewer trips to and from the platform and thereby reduce the cost of transportation. The cost of cradled containers is relatively insignificant when compared to the hourly rates of workboats.

The unique stacking features of the cradle will also allow for non-cradled containers to be stacked upon a cradle, whether that particular cradle unit is holding a container or not. The cradle is provided with multiple locking points on the bottom and topside of the unit to facilitate a stacking. The locking points utilize a pin and hole system and interlocking base supports that work together to facilitate stacking. The pin and hole system is designed to match the corner castings of ISO standard containers so that containers and the cradle itself will interlock upon stacking.

When utilized with a standard ISO container, the cradle and container combination will conform to the offshore regulations while allowing for the ISO container to be easily changed in and out for repair or for packing purposes. This will provide more versatility in the use of ISO containers. Because the cradle is modular and standardized, it allows for workers to keep a neat and organized workspace and thus reduce risks associated with unorganized or haphazardly stored equipment in an inherently hazardous environment.

The container cradle is intended to meet the lifting regulations imposed on the offshore industry. Such lifts are inherently hazardous in nature and potentially pose a safety risk to employees. User of the container cradle can employ non-certified baskets and containers in combination with the cradle and provide containerized lifting that meets the lifting regulations being imposed in the offshore industry. This will typically allow for heavier loads to be carried in a container and allow for fewer lifts. Because more material may be stored in a cradled container, cargo capacity is increased and the number of potentially hazardous lifts is reduced.

The cargo container also allows for a smaller footprint on the platform than the use of multiple baskets so very valuable platform space is conserved. Additionally consolidating equipment in a cradled container may avoid mistakes and inefficiencies associated with missing items in baskets and forgotten units on the dock.

Trucking to and from a port or cargo dock is also reduced because the loads can be consolidated allowing more equipment to get to the dock in fewer trips therefore reducing the overall freight bill.

Use of the cradle in combination with lockable non-certified containers will prevent or reduce the incidence of tampering or theft of the equipment and increase the likelihood that container will arrive at the desired location with the contents intact and as originally shipped. This will help to eliminate the cost and expense associated with missing parts, equipment, or at the offshore location.

Further features and advantages of the invention will be readily apparent from the specifications and from the drawings as shown herein.

DETAILED DESCRIPTION OF THE INVENTION

Figure 1:
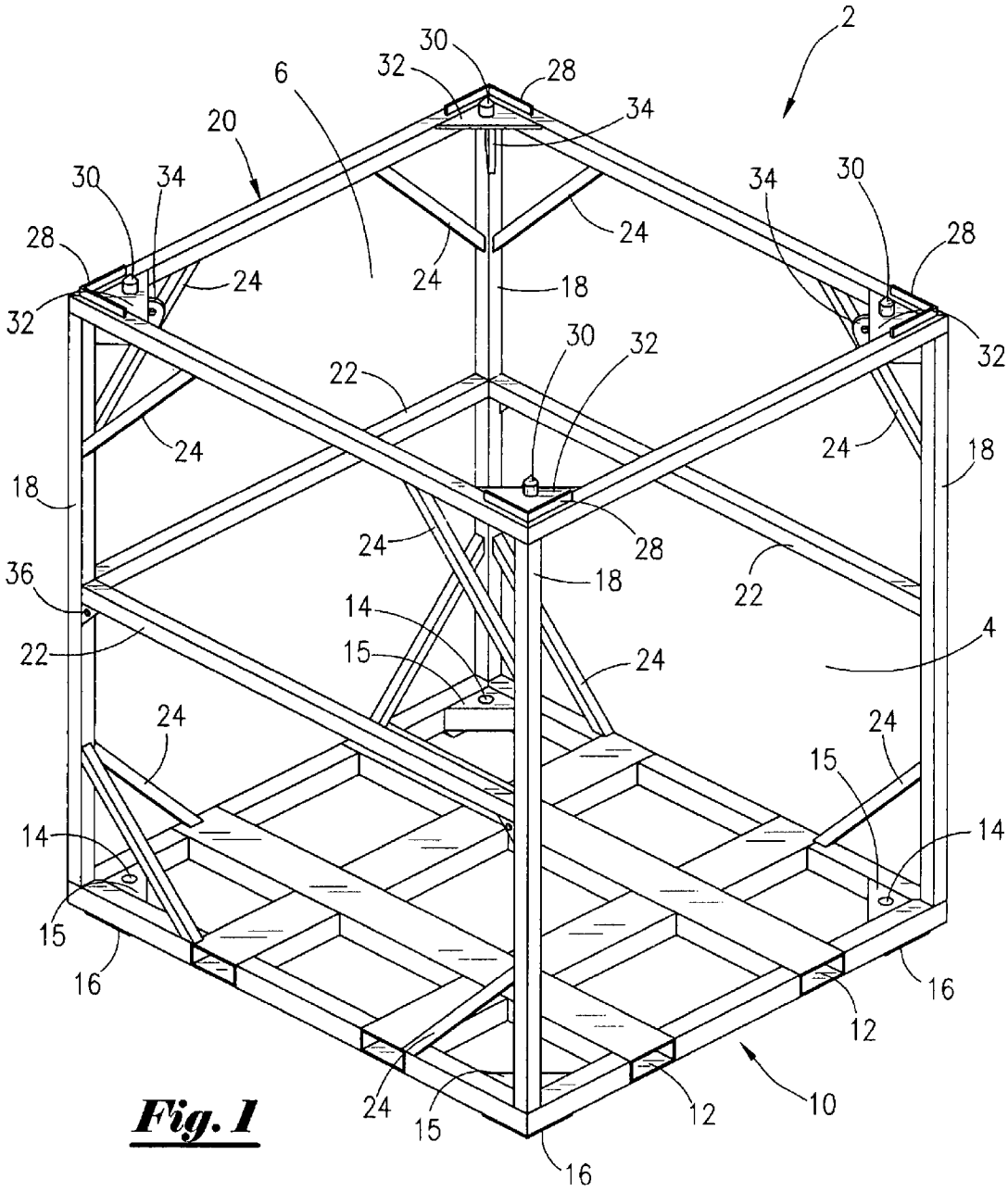
FIG. 1 is a top isometric view of the cargo cradle according to the invention.
Figure 2:
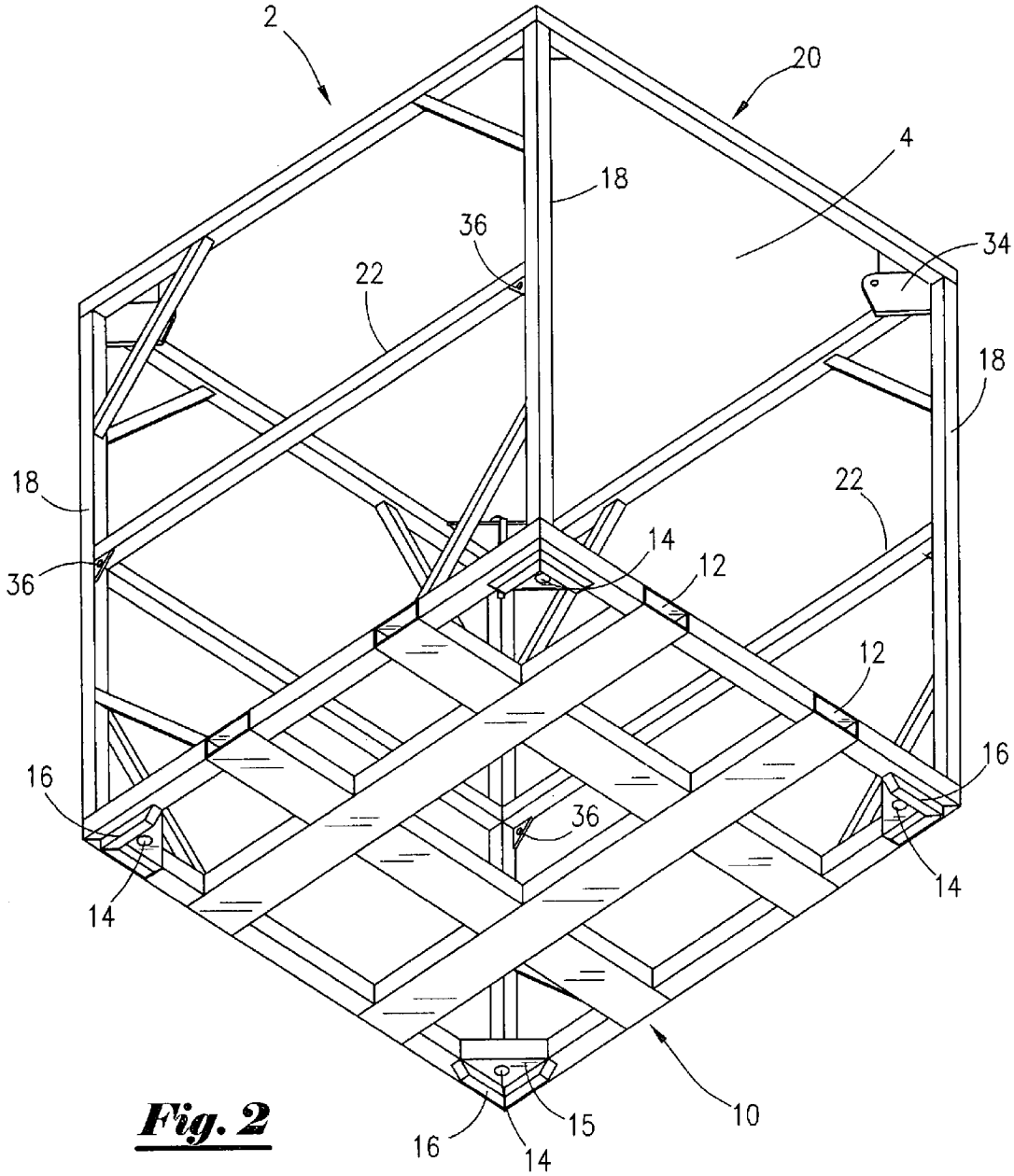
FIG. 2 is a bottom isometric view of the cargo cradle of FIG. 1.
Figure 3:
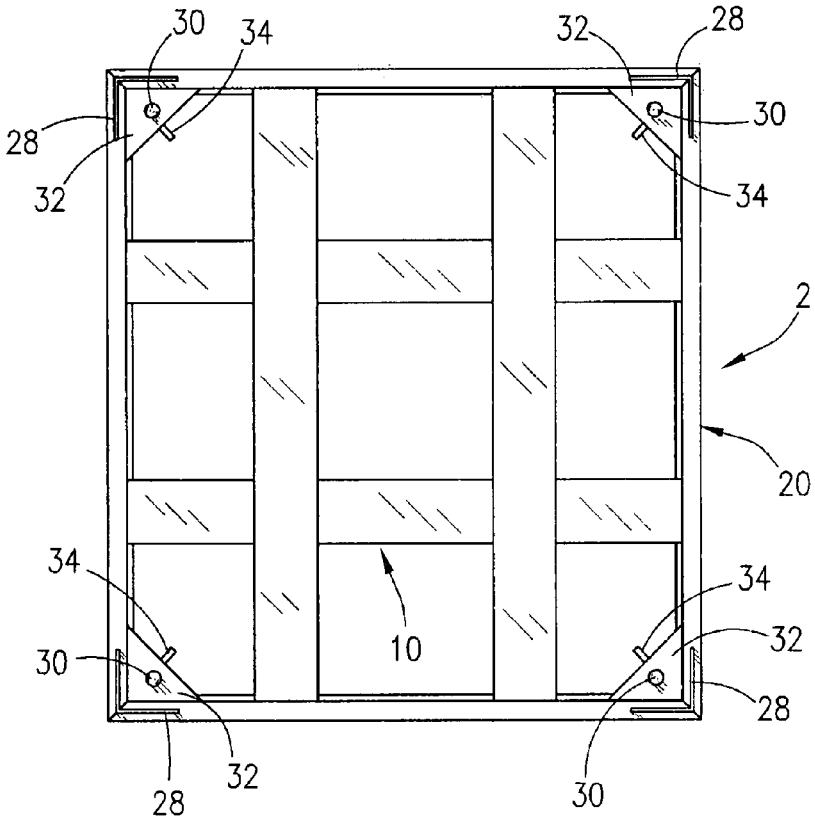
FIG. 3 is a top plan view of the cargo cradle of FIG. 1.
Figure 4:
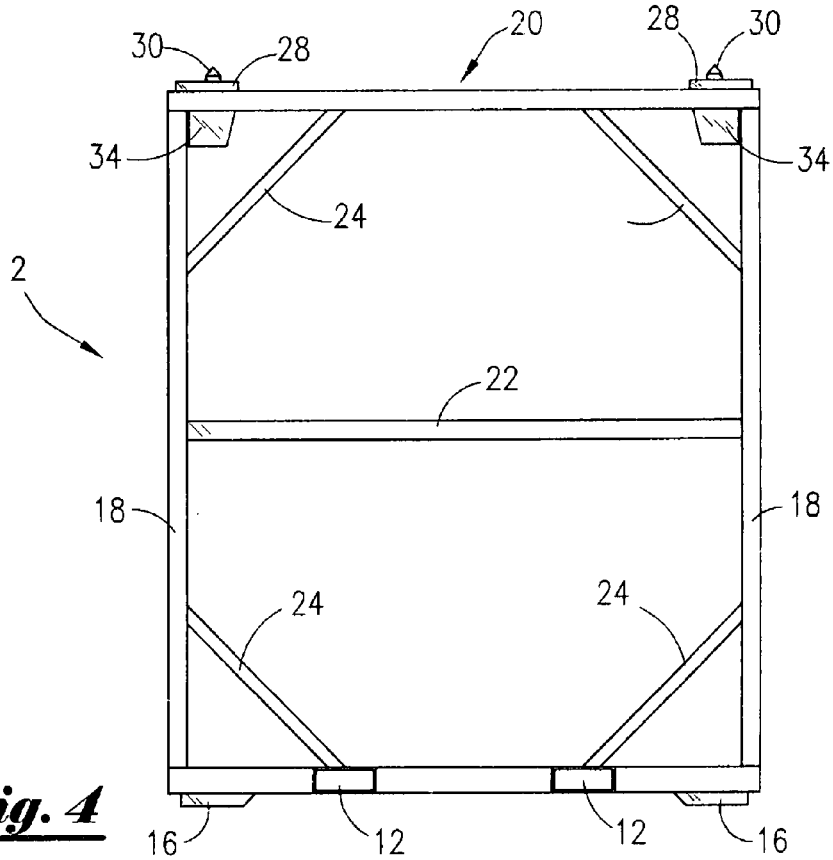
FIG. 4 is a side view of the cargo cradle of FIG. 1.
Figure 5:
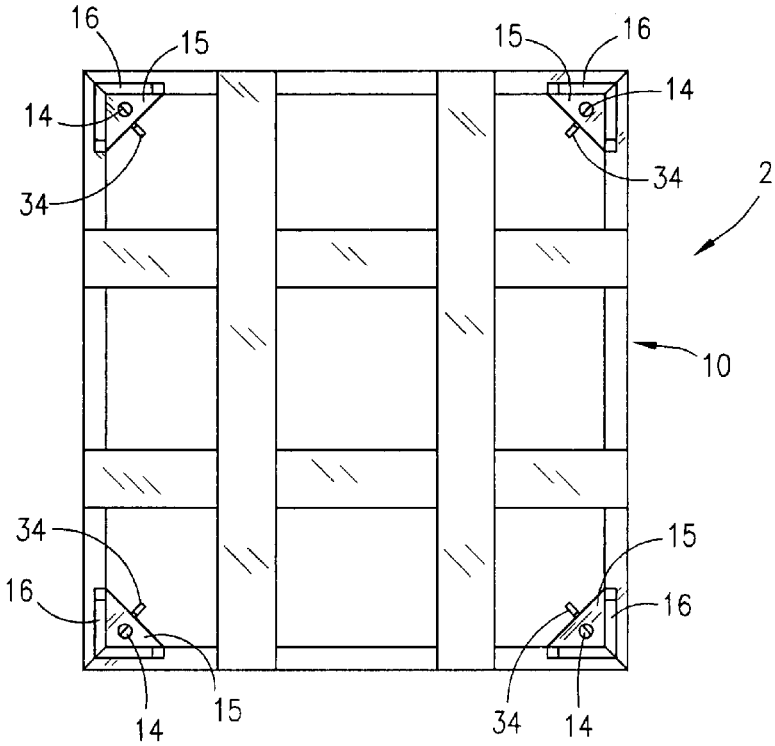
FIG. 5 is a bottom plan view of the cargo cradle of FIG. 1.
Figure 6:
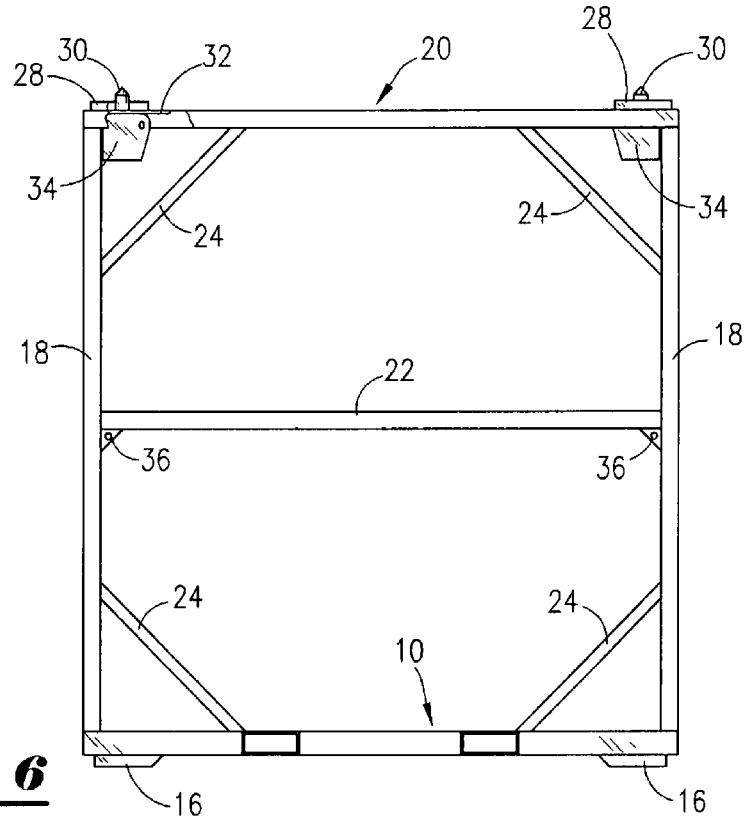
FIG. 6 is an end view of the cargo cradle of FIG. 1.

Referring to FIGS. 1 and 6, the cargo container cradle 2 is a single bay cradle unit intended to support at least one non-certified containers or baskets. It is comprised of a floor or base frame 10 made up of a network of beams and braces. The base frame 10 has openings 12 positioned to receive the tines of a forklift or pallet jack to facilitate the lifting of the cradle. Extending from each corner of the base frame 10 are base frame support bars 16. These base support bars 16 keep the cradle 2 off the deck or floor surface to avoid the accumulation of moisture around the cradle. Angled corner plates 15 extend from each corner of the base frame 10 inward toward the interior of the base frame 10. These corner plates 15 strengthen the base frame 10 and provide space for holes 14 to receive stacking pins 30 to facilitate stacking and interlocking of cradles 2 when the cradles 2 are stacked one upon another.

The base frame 10 has vertically extending support posts 18 upon which is mounted a top horizontally oriented frame 20. Lateral framing 22, corner frame bracing 24 and angle bracing 36 is provided for rigidity and structural support of the posts 18. A bay opening 4 is formed at one end to provide for the insertion of a cargo container or basket within the cradle 2. The framing 22 and bracing 24 and the opening 4 may be situated and dimensioned to provide for the opening and closing of doors in ISO compliant containers.

Figure 7:
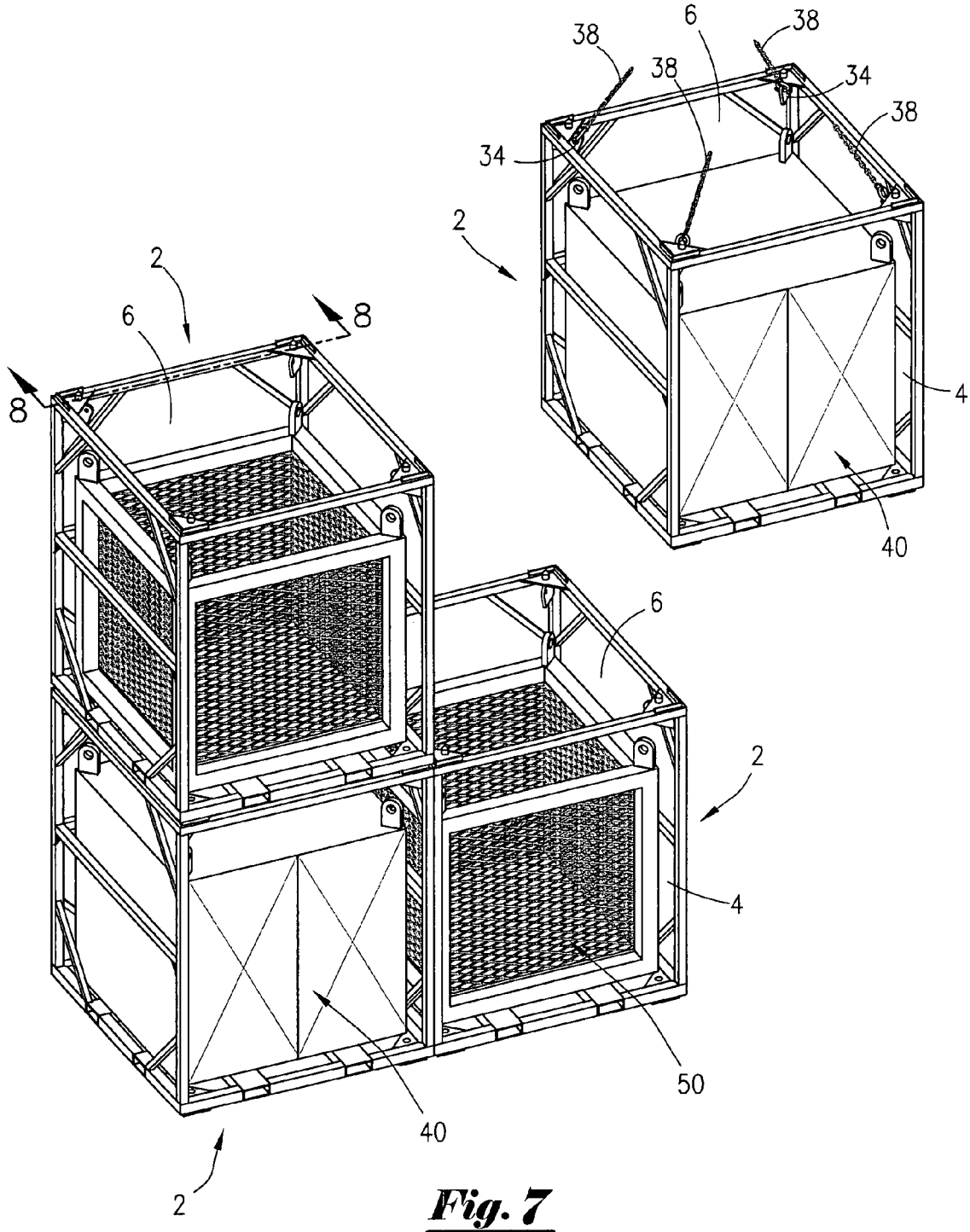
FIG. 7 is a perspective view of the cargo cradle of FIG. 1 showing the lifting and stacking capabilities of such loaded cargo cradles.
Figure 9:
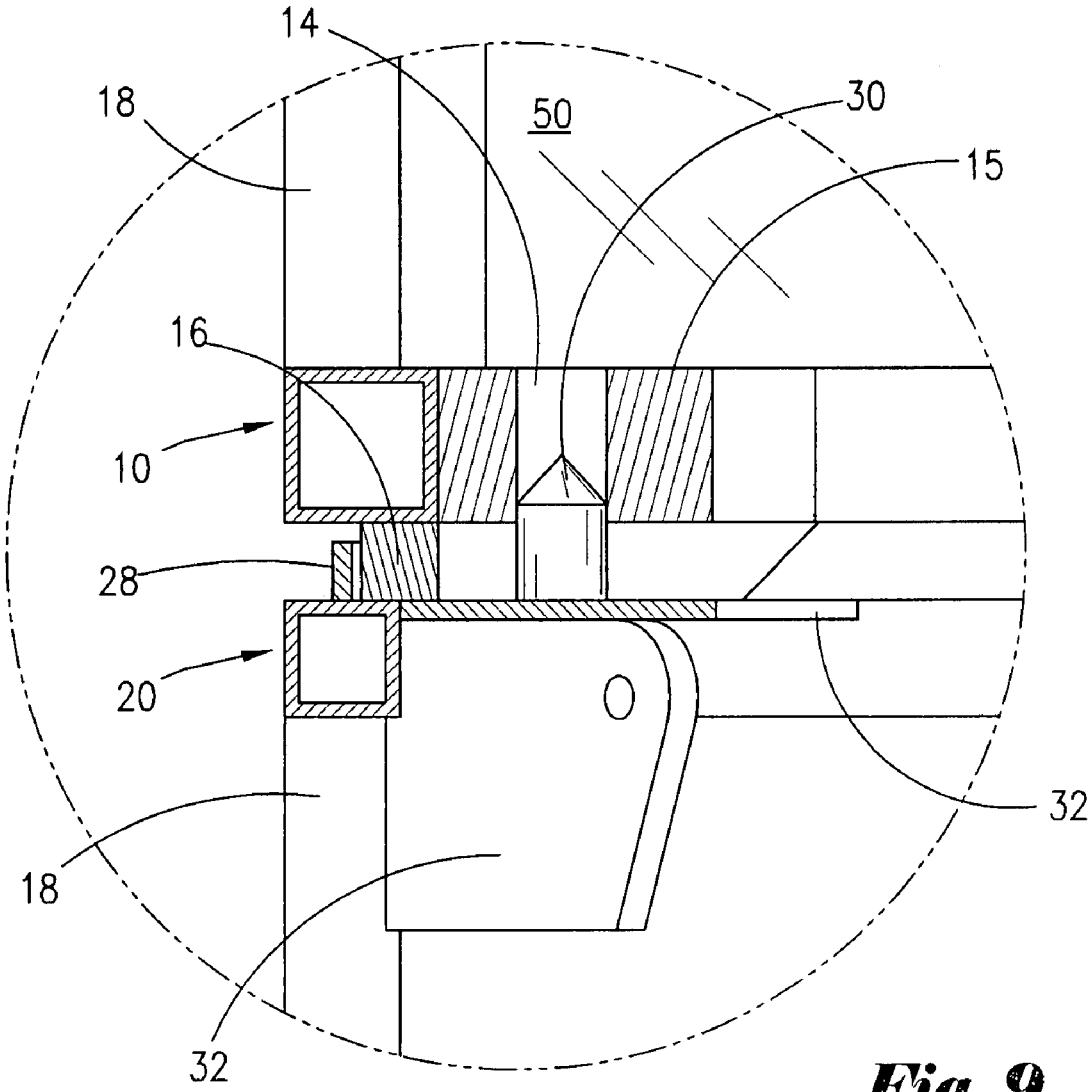
FIG. 9 is a detail view illustrating the stacking pin elements of the cargo cradle.

The top frame 20 has upper support bars 28. The upper support bars 28 are offset from the base frame support bars 16 so that the support bars 16 and 28 will nest side by side and interlock when one cradle 2 is stacked upon another cradle 2 as shown in FIG. 7. The top frame 20 has angled corner plates 32 that extend from each corner of the top frame 20 inward toward the interior of the top frame 20. These corner plates 32 strengthen the top frame 20 and provide support for the stacking pins 30 protruding upwardly from the corner plates 32. When cradles 2 are stacked one upon another, the stacking pins 30 of the lower support curdle 2 are inserted into the holes 14 of the of the upper cradle 2 to further interlock the upper and lower cradles 2. When the stacking pins 30 extending from the corner plates 32 of the lower support curdle are inserted into the holes 14 of the corner plates 15 of the upper cradle 2, the upper support bars 28 of the lower cradle 2, offset from the base frame support bars 16 of the upper cradle 2, will nest side by side with the frame support bars 16 of the upper cradle 2 and interlock as shown in FIG. 9.

Lifting lugs or padeyes 34 extend inwardly in the cradle 2 from the corner posts 18 and are recessed below the level of the top frame 20. The lifting lugs 34 allow for the attachment of lifting cables or chains 38 through opening 6 of the top frame 20 at a level below the top frame 20 whereby the cradle 2 may be lifted for transportation. The location of the padeyes 34 on the interior of the cradle 2, below the top frame 20, allows for the lifting of the cradle 2 but still allows cradles 2 to be stacked one upon the other without the interference of the padeyes 34, all as shown in FIG. 7. The opening 6 also loads the cradle 2 to be loaded from the top as well as from the side bay opening 4.

The base frame 10, support posts 18, framing 22 and 24, top frame 20, and padeyes 34 of the container cradle 2 are engineered to comply with the strength and structural integrity requirements of the DNV standards, including the designated lifting requirements, so that the cradles 2 may be certified compliant for use in the marine and offshore oil and gas industries. The container cradle 2 may be manufactured from any suitable material such as steel, aluminum or other suitable metals or metal alloys. Preferably the materials used are corrosion resistant by means of galvanization techniques where suitable and may be painted with marine grade paint or other suitable corrosion control coatings.

Figure 8:
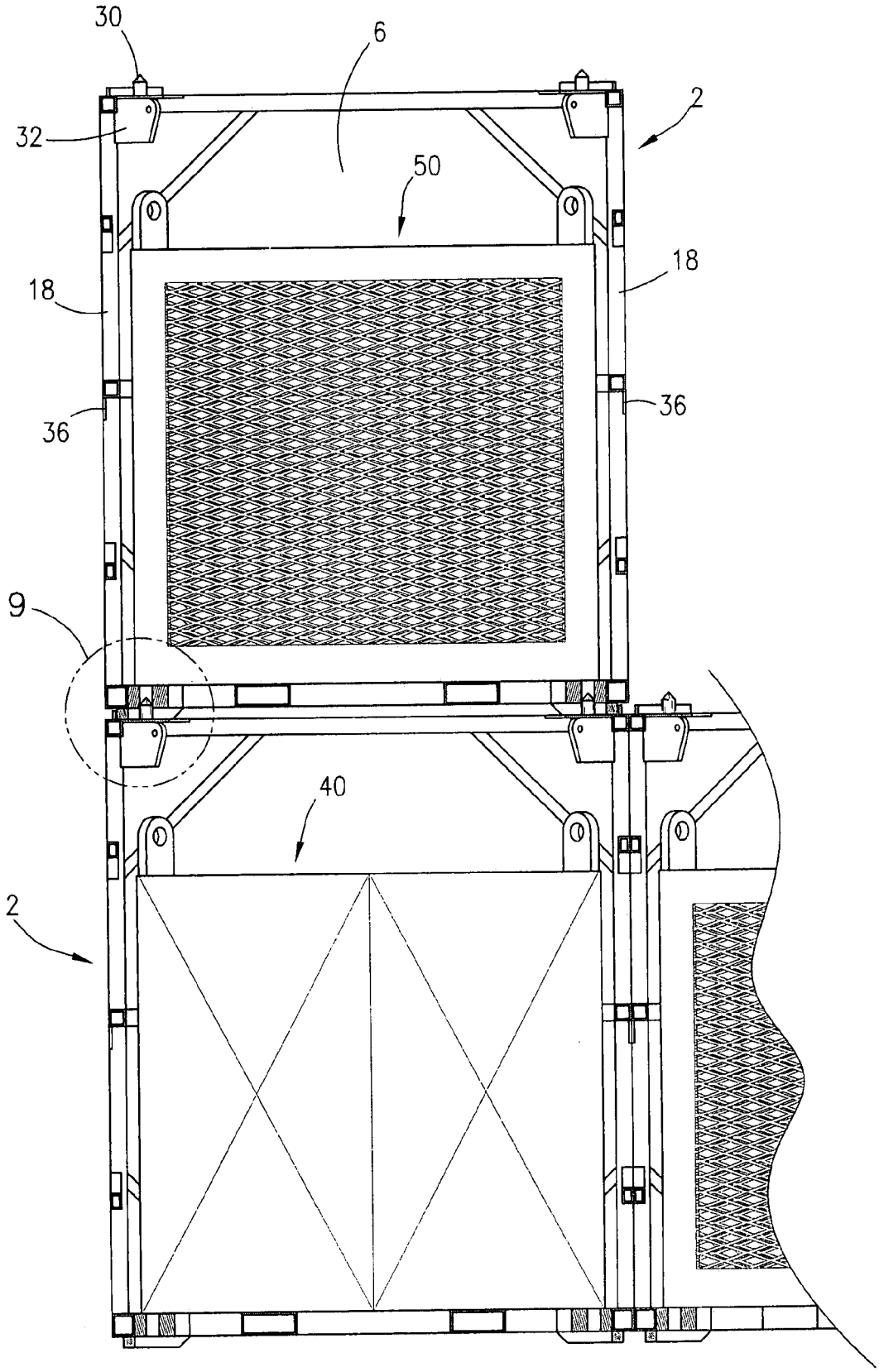
FIG. 8 is a partial section view of the stacked cradles shown in FIG. 7.

FIG. 7 shows the stacking and lateral placement of adjoining container cradles 2. As shown, the container cradles 2 may be used to support non-compliant containers 40 and open cargo baskets 50 which may be inserted into a container cradle 2 through bay opening 4. When stacked the holes 16 the base frame 10 of the upper cradle 2 are inserted into the stacking pins 30 of the top frame 20 of the upper cradle 2 for interlocking the upper cradle 2 with the corresponding lower cradle 2. The interlocking the upper cradle 2 with the corresponding lower cradle 2 is shown in the encircled area 9 and in more detail in FIG. 8.

FIG. 9 is a detail view illustrating the stacking pin elements of the cargo cradle. The base frame 10 of the upper cradle 2 is shown in alignment with the upper frame 20 of the lower cradle 2. The support bars 28 of the top frame 20 of the lower cradle 2 are offset from the support bars 16 of the base frame 10 of the upper cradle 2 so that the support bars 16 and the support bars 28 nest side by side and interlock when one cradle 2 is stacked upon another cradle 2 as shown. Vertically projecting stacking pins 30 of the lower cradle 2 are inserted in the corresponding hole 14 in the corner plates 15 of the upper cradle 2 to facilitate stacking and interlocking of cradles 2 when the cradles 2 are stacked one upon another. If desired, a ladder may be provided as an attachment to the side of cradle 2 to provide access to the top of the cargo cradle.

Figure 10:
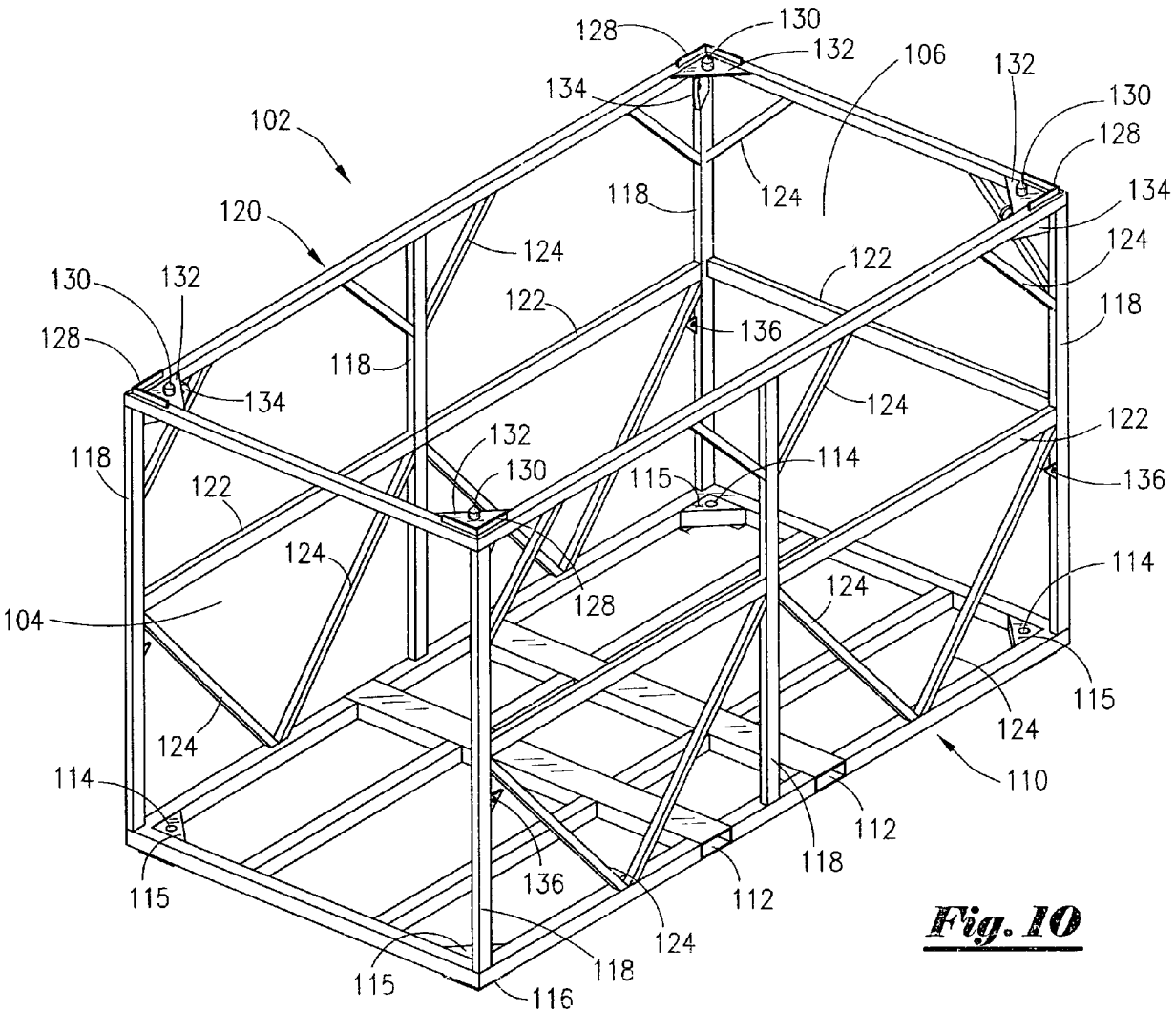
FIG. 10 is a top isometric view of a double cargo cradle according to the invention.
Figure 11:
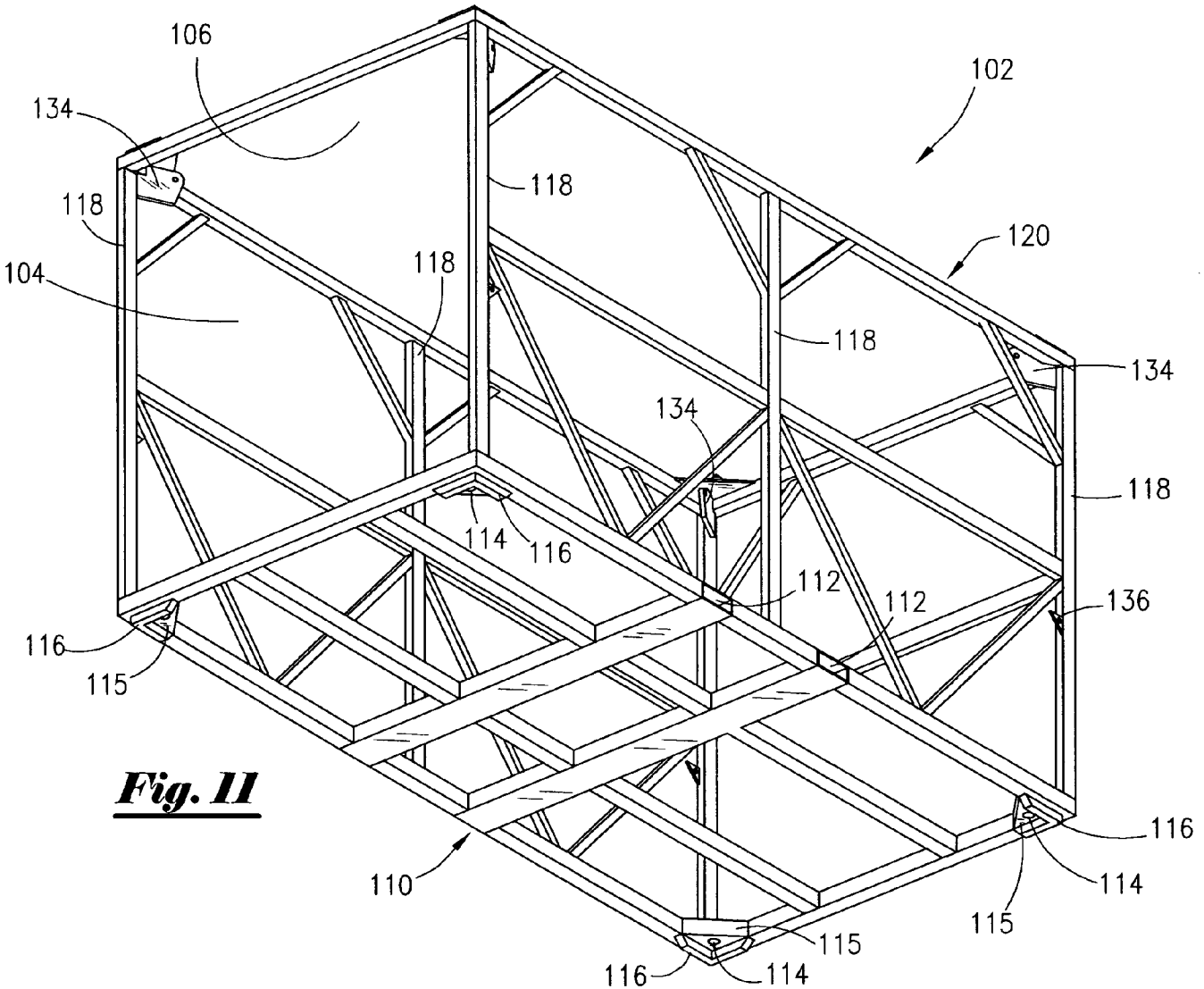
FIG. 11 is a bottom isometric view of the double cargo cradle of FIG. 10.

FIG. 10 and FIG. 11, respectively, show a top and bottom perspective view of an alternative embodiment of the proposed cargo container cradle shown as 102. The alternative embodiment is shown as a double or extended cargo container. The extend cradle 102 may be used for supporting, transporting and storing larger non-certified bulk cargo containers or for multiple smaller cargo containers or shipping baskets. This extended cargo container cradle 102 is also intended to satisfy and comply with "DNV Offshore Container Regulation 2.7-1 and may also be configured to conform to the dimensional standards of ISO containers so that such containers will be readily retained in the cradle 102. It may be configured to accommodate a shipping container of any desired size including those containers that are 20 feet in width by 40 feet in length that are primarily used by international shippers.

The extended cargo container cradle 102 shown in FIGS. 10 and 11 will support at least one non-certified DNA container or multiple cargo baskets. The cradle 102 may also be configured to receive and ISO standard shipping container of a designed size.

The cradle 102 is comprised of a floor or base frame 110 made up of a network of beams and braces. The frame 110 has openings 112 positioned to receive the tines of a forklift or pallet jack to facilitate the lifting of the cradle. The base frame 110 is provided with supports 116 to keep the cradle 102 off of the deck or floor surface to avoid the accumulation of moisture around the cradle. Angled corner plates 115 are provided to strengthen the base frame110 and holes 16 are provided in the corner plates 115 for receiving stacking pins 130 to facilitate stacking and interlocking of cradles 102, when the cradles 102 are stacked one upon another.

Attached to the base frame 110 are vertically extending support posts 118 upon which is mounted a top horizontally oriented frame 120. Lateral framing 122, corner brace framing 124 and angle bracing 136 is provided for rigidity and structural support of the posts 118. Angle supports 132 may be provided to support the connection of lateral framing 122 and posts 118 and for an anchor block that may be used in connecting adjoining cradles 102. A bay opening 104 is provided to allow the insertion of a cargo container or basket within the cradle 102. The framing 122 and bracing 124 and the opening 104 may be situated and dimensioned to provide for the opening and closing of doors in ISO compliant containers.

Top frame 120 has supports 128 offset from base frame supports 116 so that the supports 116 and 128 will nest side by side and interlock when one cradle 102 is stacked upon another cradle 102. The top frame 120 has angled corner plates 132 provided to strengthen the base frame and to support the stacking pins 130. The top frame 120 has lifting lugs or padeyes 134 that extend inwardly from the corner posts 118. These padeyes 134 are recessed below the level of the frame 120.

The lifting lugs or padeyes 134 allow for the attachment of lifting cables or chains 38 through opening 106 of the top frame 120 at a level below the top frame 120 whereby the cradle 102 may be lifted for transportation. The location of the padeyes 134 on the interior of the cradle 102, below the top frame 120, allows for the lifting of the cradle 102 while allowing cradles 102 to be stacked one upon the other without the interference of the padeyes 134. Opening 106 of the top frame 120 may also be used as a loading bay. A ladder may be provided along the side of cradle 102 to provide easy access to the top of the cargo cradle.

From the disclosure, it can be appreciated that cradles 2 and 102 may be configured with the side framing and braces to facilitate access to the doors and openings of standardized containers. It can also be appreciated that each cargo container employed for use with a cargo container cradle 2 or 102 will be either permanently or temporarily mounted to the cradles 2 and 102. Such mounting of the containers on the cradles may be accomplished by strapping, bolting, welding, or other suitable means.

The container may be utilized with pallet jacks and forklifts and with cranes by means of the lifting padeyes. The cradles 2 and 102 may also serve as a crash frame for the internal cargo containers so as to provide additional protection for the cargo being stored. The interlocking frame supports and pins maintain the stability of stacked containers and serve to keep the stacked cradles stationary and to help to prevent the shifting or sliding of the cradles with respect to each other when they are jolted or shifted.

It is thought that the method and apparatus for the testing of a cargo container cradle described herein and many of its intended advantages will be understood from the foregoing description. It is also thought that various changes in form, construction, and arrangement of the parts of the method and apparatus may be made without departing from the spirit and scope of the invention described herein. The form herein described is intended to be merely an illustrative embodiment of the invention.

We claim:

1. An apparatus for supporting and reinforcing cargo containers comprising:

(a) first and second cradle frames, each of said cradle frames having a horizontally oriented rectangular base frame, said base frame defining four sides and four base frame corners, support posts attached to and extending vertically upward from said base frame, a horizontally oriented top frame, said top frame defining four sides and four top frame corners around a central opening, said top frame attached to and supported on said support posts, and framing attached to said support posts, wherein said sides of said base frame and said sides of said top frame, and said framing defining an opening to said cradle frame, whereby a cargo container may be inserted;

b) lifting lugs extending inwardly toward the center of said top frame from said top frame corners of each of said cradle frames, said lugs being recessed below an upper surface of said top frame whereby said lifting lugs may be attached to lifting cables from above said top frame through said central opening of said top frame;

c) base frame support bars mounted to and below said base frames of each of said cradle frame, said base frame support bars extending along the periphery of each said base frame from each of said base frame corners;

d) top support bars mounted to said top frame of each of said cradle frames so as to extend upward from each of said top frames, said top support bars extending along the periphery of each said top frame from each of said top frame corners, each of said top support bars being offset from said base frame support bars of said base frame of each of said cradle frames whereby said top support bars and said base frame support bars will nest side by side and interlock when said first cradle frame is stacked upon said second cradle frame;

e) a horizontally oriented base frame corner plate positioned at each said base frame corner of each said cradle frame, each said base frame corner plate having a hole for receiving a pin, and a horizontally oriented top frame corner plate positioned at each said top frame corner of each said cradle frame, each said top frame corner plate having a vertically upward extending pin, whereby when said first cradle frame is lifted and stacked upon said second cradle frame, said pin of each said top frame corner plate of second cradle frame is received within a said hole of a corresponding said base frame corner plate of said first cradle frame so as to interlock said first cradle frame atop said second cradle frame; and f) a cargo container inserted upon each said base frame of each of said cradle frames.

2. The apparatus as recited in claim 1 wherein each said base frame of each said cradle frame has openings along at least one of said side for receiving tines of a fork lift apparatus.

3. An apparatus for supporting and reinforcing cargo containers comprising:

(a) A plurality of cradle frames, each of said cradle frames having:

(i) a horizontally oriented rectangular base frame, each said base frame defining four sides and four base frame corners, a horizontally oriented top frame, each said top frame defining four sides and four top frame corners around a central opening, support posts attached to said base frame and to said top frame, said support posts extending between said base frame and said top frame whereby said top frame is supported on said support posts, and framing around said support posts, said framing defining an opening to each of said cradle frames, whereby a cargo container may be inserted;

(ii) base frame support bars mounted to and below each of said base frames, said base frame support bars extending along the periphery of each said base frame from each of said base frame corners (iii) top support bars mounted to each said top frame, said top frame support bars extending upward from said top frame and along the periphery of each said top frame from each of said top frame corners, said top support bars of each said cradle frame being offset with respect to said base frame support bars of each said cradle frame;

(iv) a horizontally oriented base frame corner plate positioned at each said base frame corner of each said cradle frame, each said base frame corner plate having a hole for receiving a pin;

(v) a horizontally oriented top frame corner plate positioned at each said top frame corner of each said cradle frame, each said top frame corner plate having a vertically upward extending pin;

b) lifting lugs attached to said each cradle frame of said plurality of cradle frames, said lifting lugs extending inwardly within said central opening of said top frame of each said cradle frame and recessed below an upper surface of said top frame, whereby when one of said plurality of cradle frames is lifted and stacked atop a selected another of said plurality of cradle frames by means of lifting cables extending through said central opening of said top frame of said selected lifted cradle frame attached to said lifting lugs, each said hole of said base frame corner plate of said selected lifted cradle frame receives a corresponding pin of said top frame corner plate of said selected other cradle frame so as to interlock said selected cradle frames together with said base frame support bars of said selected lifted cradle frame nested side by side with said top support bars of said selected other cradle frame without interference from said lifting lugs of said selected other cradle frame; and c) a cargo container inserted upon said base frame of each said cradle frame of said plurality of cradle frames.

4. The apparatus as recited in claim 3 wherein each said base frame of each said cradle frame of said plurality of cradle frames has openings for receiving tines of a fork lift apparatus.

* * * * *